US010655344B1

(12) United States Patent
Jones

(10) Patent No.: US 10,655,344 B1
(45) Date of Patent: May 19, 2020

(54) COVE BASE WITH CHANNEL FOR SEALANT

(71) Applicant: Larry Jones, Orient, OH (US)

(72) Inventor: Larry Jones, Orient, OH (US)

( * ) Notice: Subject to any disclaimer, the term of this patent is extended or adjusted under 35 U.S.C. 154(b) by 0 days.

(21) Appl. No.: 16/185,261

(22) Filed: Nov. 9, 2018

(51) Int. Cl.
*E04F 19/04* (2006.01)

(52) U.S. Cl.
CPC ..... *E04F 19/04* (2013.01); *E04F 19/045* (2013.01); *E04F 19/0477* (2013.01)

(58) Field of Classification Search
CPC ..... E04F 19/04; E04F 2019/0422; E04F 19/0463; E04F 19/0468; E04F 19/061; E04F 19/0477; E04F 19/045; H02G 3/0425
USPC ..... 52/287.1, 288.1, 290
See application file for complete search history.

(56) References Cited

U.S. PATENT DOCUMENTS 1,585,960 A 5/1926 Baum
1,722,660 A 7/1929 Connelly
2,178,501 A * 10/1939 Staneampiano ..... E04F 19/045 52/288.1
2,230,688 A * 2/1941 Irwin ..... E01C 11/106 404/65
3,201,909 A * 8/1965 Heinrich ..... E04F 19/0463 52/288.1
3,222,837 A * 12/1965 Daley ..... A47K 3/008 52/287.1
4,411,112 A * 10/1983 Golden ..... E04B 1/6803 404/65
4,829,731 A * 5/1989 Schluter ..... E04F 19/049 52/287.1
5,010,703 A * 4/1991 Pearlman ..... A47G 27/0456 52/273
5,212,923 A 5/1993 Pelosi et al.
5,367,842 A * 11/1994 Janesky ..... E04B 1/7023 52/169.5
5,598,681 A * 2/1997 DiGianni ..... H02G 3/0425 52/288.1
6,189,276 B1 * 2/2001 Pinto ..... E04F 19/04 52/287.1
6,282,855 B1 * 9/2001 Shipton ..... E04F 19/045 52/287.1
6,324,799 B1 * 12/2001 Salvitti ..... E04F 19/045 52/287.1
6,802,161 B1 * 10/2004 Robinson ..... A47K 3/008 52/287.1
7,404,272 B2 7/2008 Piche
(Continued)

OTHER PUBLICATIONS

Tarkettna.com, TightLock Wall Base Systems webpage, Nov. 19, 2018, 1 page.

(Continued)

*Primary Examiner* — Brent W Herring
(74) *Attorney, Agent, or Firm* — Standley Law Group LLP; Adam J. Smith; Jeffrey S. Standley

(57) ABSTRACT

A cove base for sealing a gap between a wall and a floor using a sealant is provided. The cove base comprises a base configured to extend along a portion of the wall when installed. A shoe extends at an angle from the base and is configured to extend towards the floor and away from the wall when installed. A heel extends from the shoe and is configured to contact the floor when installed. A channel configured to receive the sealant is defined by the space between the heel and the shoe.

5 Claims, 5 Drawing Sheets

(56) References Cited

U.S. PATENT DOCUMENTS

| | | | | |
|---|---|---|---|---|
| 7,703,249 | B2 * | 4/2010 | Rachak | E04F 19/04 52/288.1 |
| 7,797,900 | B2 * | 9/2010 | Sondermann | E04F 19/062 52/287.1 |
| 8,572,919 | B1 * | 11/2013 | Neill | E04F 19/061 52/466 |
| 8,729,408 | B2 * | 5/2014 | Pawlak | E04F 19/04 174/504 |
| 8,973,321 | B2 * | 3/2015 | Pelosi | E04F 13/0733 52/287.1 |
| 8,997,414 | B2 * | 4/2015 | Fletcher | F16J 15/14 52/255 |
| 9,464,429 | B2 * | 10/2016 | Johnson | A47K 3/008 |
| 9,970,202 | B2 | 5/2018 | Kimel | |
| 2008/0005986 | A1 * | 1/2008 | Thompson | E04B 2/82 52/290 |
| 2008/0134602 | A1 * | 6/2008 | Schick | E04F 19/0486 52/287.1 |
| 2010/0186329 | A1 * | 7/2010 | Buys | A47B 77/022 52/288.1 |
| 2011/0108318 | A1 * | 5/2011 | Pawlak | E04F 19/04 174/504 |
| 2014/0137496 | A1 * | 5/2014 | Fletcher | F16J 15/14 52/287.1 |
| 2015/0252561 | A1 * | 9/2015 | Johnson | A47K 3/008 52/272 |
| 2016/0215508 | A1 | 7/2016 | Kimel | |

OTHER PUBLICATIONS

Homedepot.com, Cove Base search results webpage, Nov. 9, 2018, 3 pages.

Speedcove, Inc. d.b.a Solid Rock Enterprises, SpeedCove webpage (www.speedcove.com), Oct. 29, 2018, 4 pages.

Easycove, www.easycove.com webpage, Oct. 29, 2018, 4 pages.

Rocktred, Easycove, https://rocktred.com/easycove.php, Oct. 22, 2018, 5 pages.

DIYbasement Youtube Page, How to Seal a Wet Basment Water-tight, https://www.youtube.com/watch?time_continue=74&v=N1vu0F6qgOA, Sep. 22, 2017, 1 page.

Waterproof.com, SealOnce Basement System webpage, https://waterproof.com/products/sealonce-basement-system-main-section/, Oct. 16, 2018.

Larry Jones, photos of Existing Baseboards, Oct. 22, 2018.

* cited by examiner

COVE BASE WITH CHANNEL FOR SEALANT

CROSS-REFERENCE TO RELATED APPLICATION

This application makes no priority claim.

TECHNICAL FIELD

Exemplary embodiments of the present invention relate generally to a cove base with a channel for receiving a sealant.

BACKGROUND AND SUMMARY OF THE INVENTION

Wall base is a trim item used for decorative and functional purposes. Wall base is typically positioned at the bottom of a wall where the wall meets the floor. The wall base provides a decorative element and also serves to cover the otherwise unsightly meeting of the wall and the floor. Sometimes, the wall base is secured to the wall by nails or other fasteners. Other times, the wall base is secured to the wall by way of an adhesive. In many cases, installation of the wall base results in various size and shape gaps between the wall base and the floor. Sometimes such gaps are caused by uneven floors. Other times, such gaps appear over time as the building shifts and settles.

An improper seal between the wall base and the wall or floor can be problematic in many environments. For example, without limitation, hospitals and other medical care facilities often treat patients who may expel bodily fluids on the floor. When cleaning, excess fluids may be inadvertently forced into such gaps between the wall base and the floor or wall. The lingering presence of fluids may promote the growth and release of bacteria and other germs into the surrounding environment. A similar experience may be found with restrooms. Even in more common applications such as but not limited to a home or business, moisture may leak into such gaps resulting in mold, bacteria growth, rust, and the like.

Sometimes a sealant may be provided on or around the wall base to further secure the wall base in position and/or to seal such gaps. However, it is difficult to provide the even and consistent bead of sealant along a wall base required to maintain an aesthetically pleasing appearance and proper seal. This is particularly common when the wall base is a cove base type of baseboard. Often times, cove bases are comprised of a flexible type material, which makes the application of a sealant particularly difficult. To further complicate matters, cove bases may comprise a shoe which extends away from the wall to the floor and a toe which contacts the floor. The addition of such features may make application of a sealant even more difficult.

Therefore, what is needed is a cove base with a channel for receiving a sealant. The present invention is cove base with a channel for receiving a sealant.

A portion of the cove base described as a base may be configured to extend along parallel to the wall when installed. Another portion described as a shoe may extend outward from the wall at an angle from the wall when installed. The shoe may be configured to extend downward and may include a radius angle which extends away from the wall. A heel may extend from the shoe and may be configured to contact the floor. In exemplary embodiments, without limitation, the heel may be used in lieu of a toe. The space between the heel, the shoe, and the floor may define a channel for the sealant when installed. The heel may be substantially cylindrical in shape, though any shape and size is contemplated. The heel may extend towards the base.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
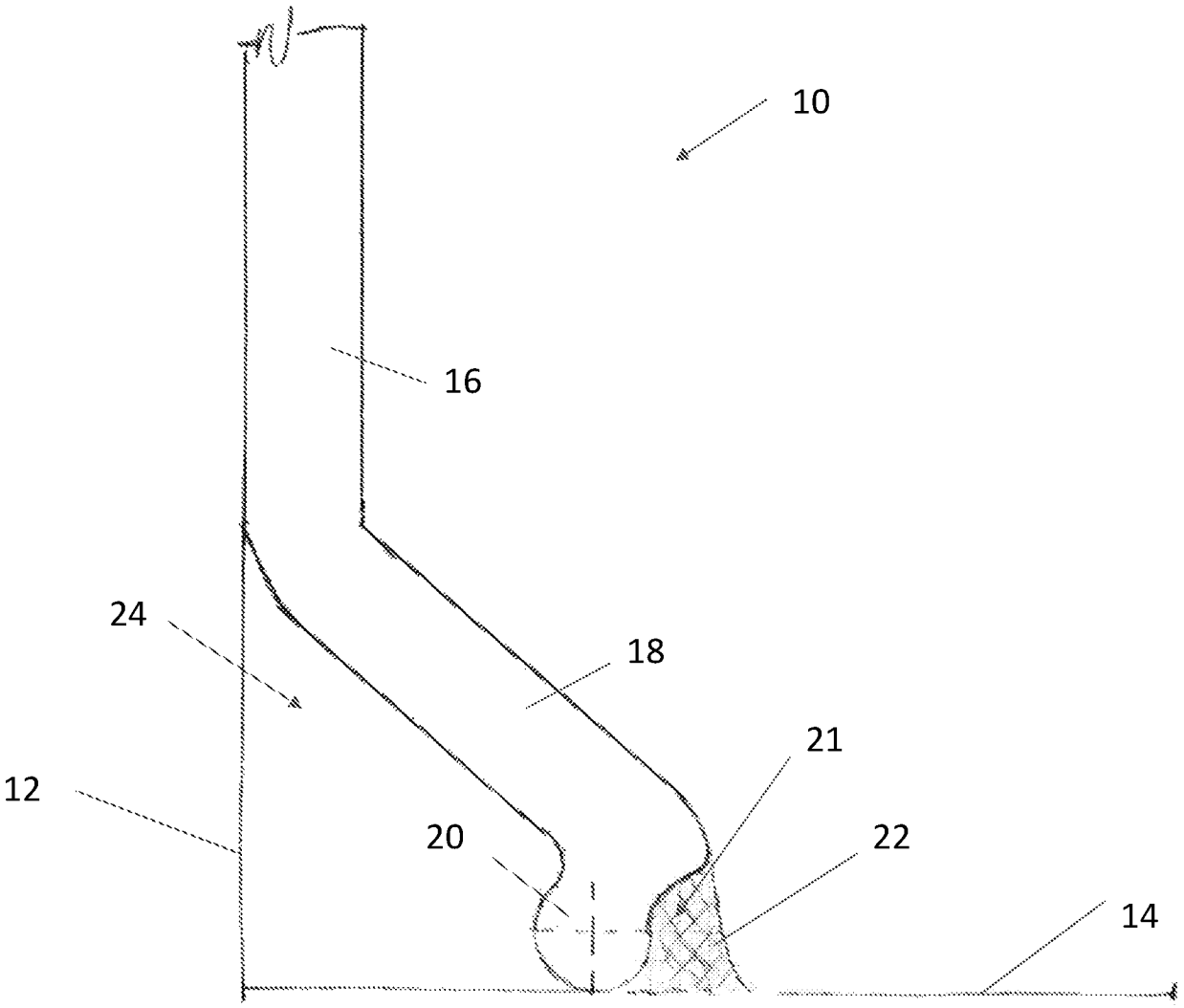
FIG. 1 is a side sectional view of an exemplary cove base in accordance with the present invention.

FIG. 1 is a side sectional view of an exemplary cove base 10. The cove base 10 may comprise a base 16. The base 16 may extend in a substantially vertical direction. The base 16 may be configured to extend along a portion of a wall 12 when installed. The wall 12 may be comprised of drywall, metal, wood, vinyl, some combination thereof, or the like. Any wall 12 material is contemplated. The cove base 10 may further comprise a shoe 18. The shoe 18 may extend at an angle from the base 16. The shoe 16 may be configured to extend away from the wall 12 and towards a floor 14 when installed. Any angle is contemplated. The floor 14 may be the ground or a raised floor such as, but not limited to, vct, tile, vinyl, linoleum, hardwood, artificial wood, concrete, some combination thereof, or the like. Any floor 14 material is contemplated. A cavity 24 may be formed between the shoe 18, the heel 20, the wall 12, and the floor 14 when installed.

A heel 20 may extend from the shoe 18. The heel 20 may be configured to extend to the floor 14 when installed. In exemplary embodiments, the heel 20 may be substantially cylindrical in shape and extend along the shoe 18 such that the heel 20 comprises a substantially circular cross section when viewed from the side. It is contemplated that the heel 20 may be any size and shape. The heel 20 may comprise any size and shape cross section. Furthermore, the size and shape of the heel 20 may vary. The heel 20, for example without limitation, may be any straight line or curved shape for receiving a sealant 22.

In exemplary embodiments, the heel 20 may extend towards the base 16 relative to the front edge of the shoe 18. In other exemplary embodiments, the heel 20 may be located a distance towards the base 16 relative to the front edge of the shoe 18. Stated another way, the heel 20 may extend towards, or be located a distance towards, the wall 12 when installed. A channel 21 may be defined by the space between a lower edge of the shoe 18 and a front surface of the heel 20. The channel 21 may be configured to receive the sealant 22. The sealant 22 may be placed within the channel 21 and may be used to provide a sealed connection between the cove base 10 and the floor 14 when installed. More specifically, in exemplary embodiments, the channel 21 may be defined by the space between the lower edge of the shoe, the front surface of the heel 20, and an upper surface of the floor 14 when installed.

The channel 21 may be configured to receive a sealant 22. The sealant 22 may be any kind of sealant, such as but not limited to, caulk, adhesive, epoxy, urethane, wax, polyurea, some combination thereof, or the like. The sealant 22 may be placed in the channel 21 before or after the channel 21 is placed into contact with the floor 14.

The cove base 10 may be comprised of rigid or flexible materials. The cove base 10, including the base 16, the shoe 18, and the heel 20, may be comprised of a rubber, plastic, polymer, vinyl, wood, metal, thermoplastic, vulcanized thermoset, some combination thereof, or the like. The various components of the cove base 10, such as the base 16, the shoe 18, and the heel 20, may be comprised of the same or different materials.

Installation of the cove base 10 may be performed by cutting the cove base 10 to a specified length. In other exemplary embodiments, the cove base 10 may be received in a predetermined size such that cutting is not required. Adhesive may be placed along the rear surface of the base 16 and/or along a corresponding section of the wall 12. The base 16 may be placed in contact with the wall 12 and the adhesive may be allowed to cure. Alternatively, or in addition, fasteners may be driven though the base 16 to secure the base 16 to the wall 12. The base 16 may be secured against the wall 12 such that the heel 20 contacts the floor 14. A layer of sealant 22 may be provided within the channel 21 such that the sealant 22 is in contact with the heel 20 and the floor 14. Alternatively, in or in addition, the layer of sealant 22 may be provided along the floor 14 and the cove base 10 may be positioned such that the sealant 22 fills the channel 21. Regardless, the sealant 22 may be smoothed. Excess sealant 22 may be removed. The sealant 22 may be allowed to cure.

In exemplary embodiments, an existing cove base 10 may be modified to form a channel 21 configured to receive the sealant 22.

Figure 2:
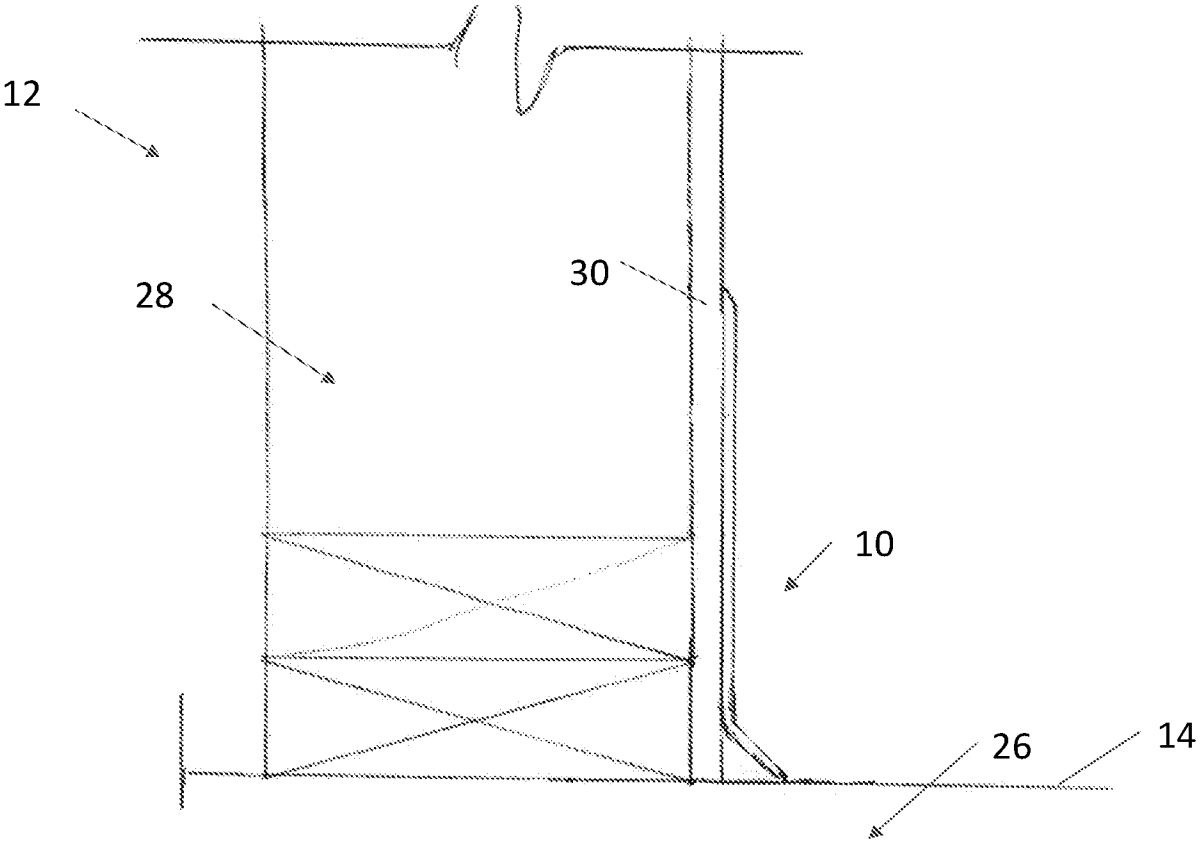
FIG. 2 is a side sectional view of an exemplary installed cove base.

FIG. 2 is a side sectional view of an exemplary installed cove base 10. A firestop 28 may be provided within the wall 12. A drywall section 30 may be located between the firestop 28 and cove base 10. The cove base 10 may extend over some or all of the drywall section 30. Concrete or another foundation material 26 may be provided below the floor 14. It is notable that the entire floor 14 may not be level such that periodic gaps or various shapes and sizes may occur between the wall 12 and the floor 14. The cove base 10 may be used, in part, to cover these gaps. However, these gaps can provide a space for bacteria, mold, insects, moisture, and the like. The use of a sealant 22 between the cove base 10 and the floor 14 may provide a proper seal to help prevent, or eliminate, the existence of bacteria, mold, insects, moisture, and the like. The channel 21 may provide a convenient and efficient space for a bead of the sealant 22 to be placed between the cove base 10 and the floor 14 when installed.

Figure 3:
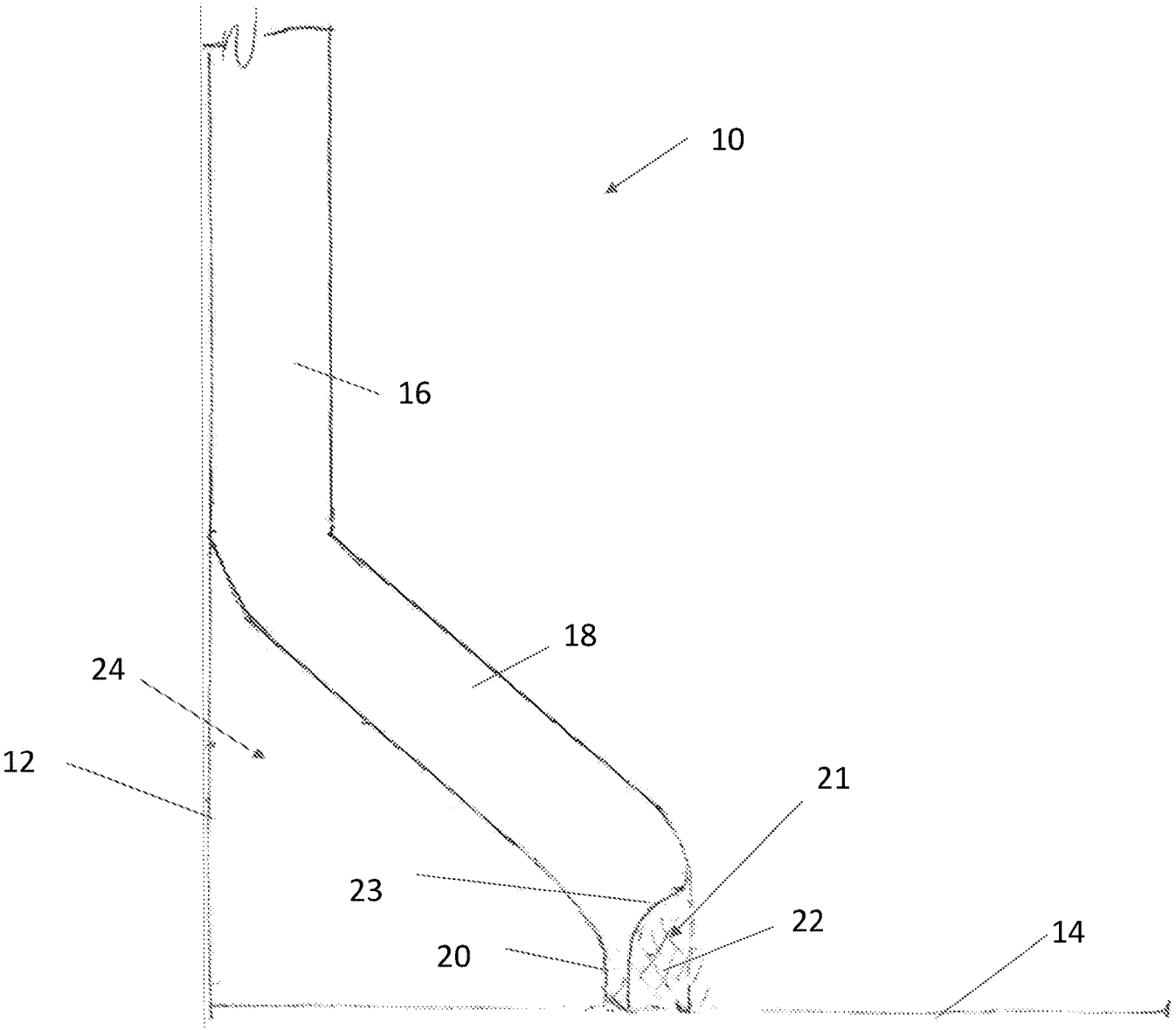
FIG. 3 is a side sectional view of another exemplary embodiment of the cove base.

FIG. 3 is a side sectional view of another exemplary embodiment of the cove base 10. The heel 20 may comprise a curved section 23 which may extend from the floor 14 to the shoe 18, when installed, to define a substantially concave shaped channel 21 for the sealant 22. Stated another way, the heel 20 may be understood as a protrusion extending downward from the shoe 18 to the floor 14, when installed, and the channel 21 may comprise a substantially quarter circle shaped recess within the heel 20 located along a front edge thereof and configured to receive a bead of the sealant 22. However, any size and shape channel 21 is contemplated and the channel 21 may vary in size and shape across one or more cove bases 10.

Figure 4:
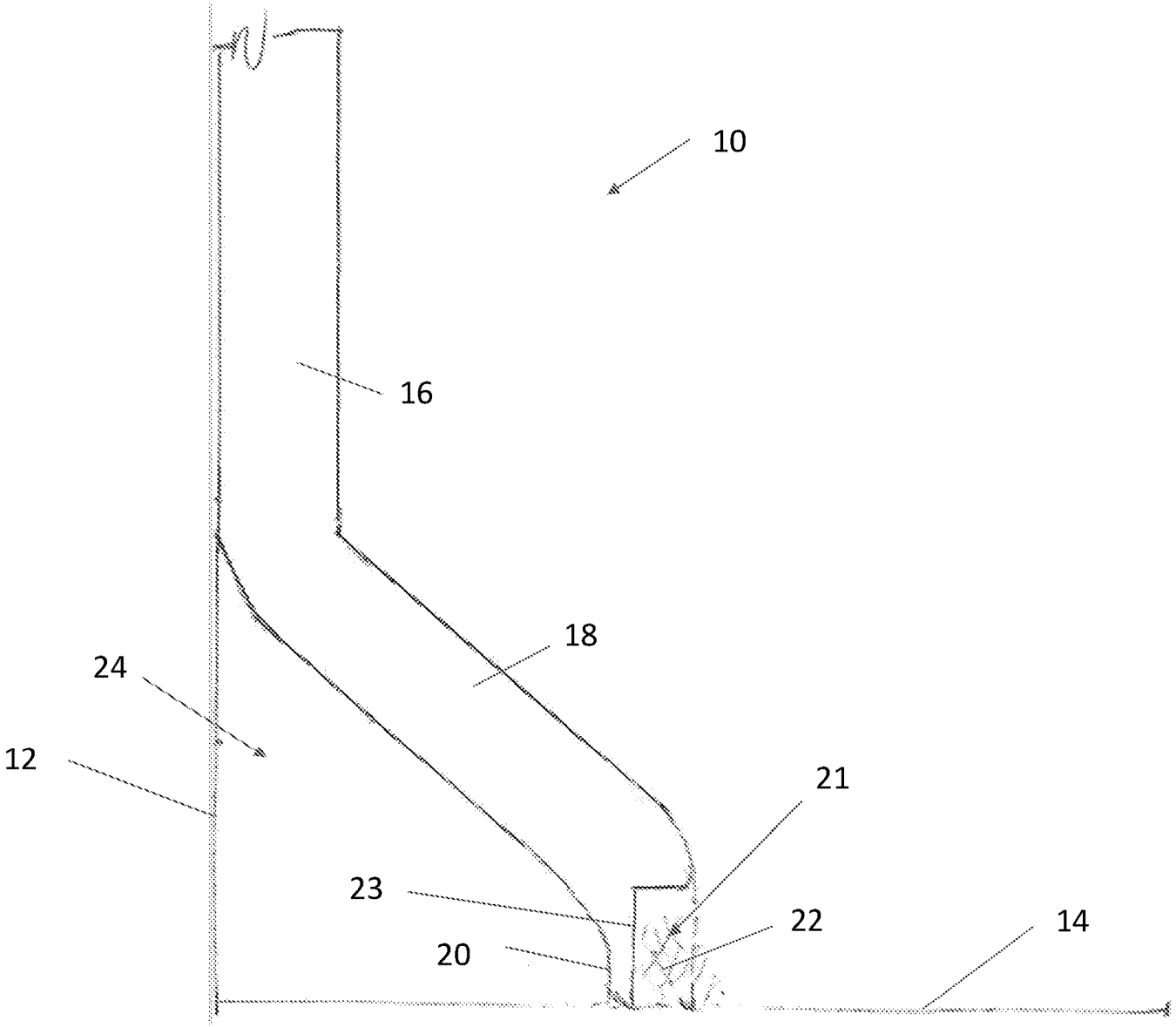
FIG. 4 is a side sectional view of another exemplary embodiment of the cove base.

FIG. 4 is a side sectional view of another exemplary embodiment of the cove base 10. The heel 20 may comprise a notched recess 23 which may extend vertically upwards from the floor 14, when installed, and horizontally to a front end of the shoe 18. Stated another way, the heel 20 may be understood as a protrusion extending downward from the shoe 18 to the floor 14, when installed. The channel 21 may comprise a substantially rectangular or square shaped opening within the heel 20 and located along a front edge thereof configured to receive a bead of the sealant 22. However, any size and shape channel 21 is contemplated and the channel 21 may vary in size and shape across one or more cove bases 10.

Figure 5:
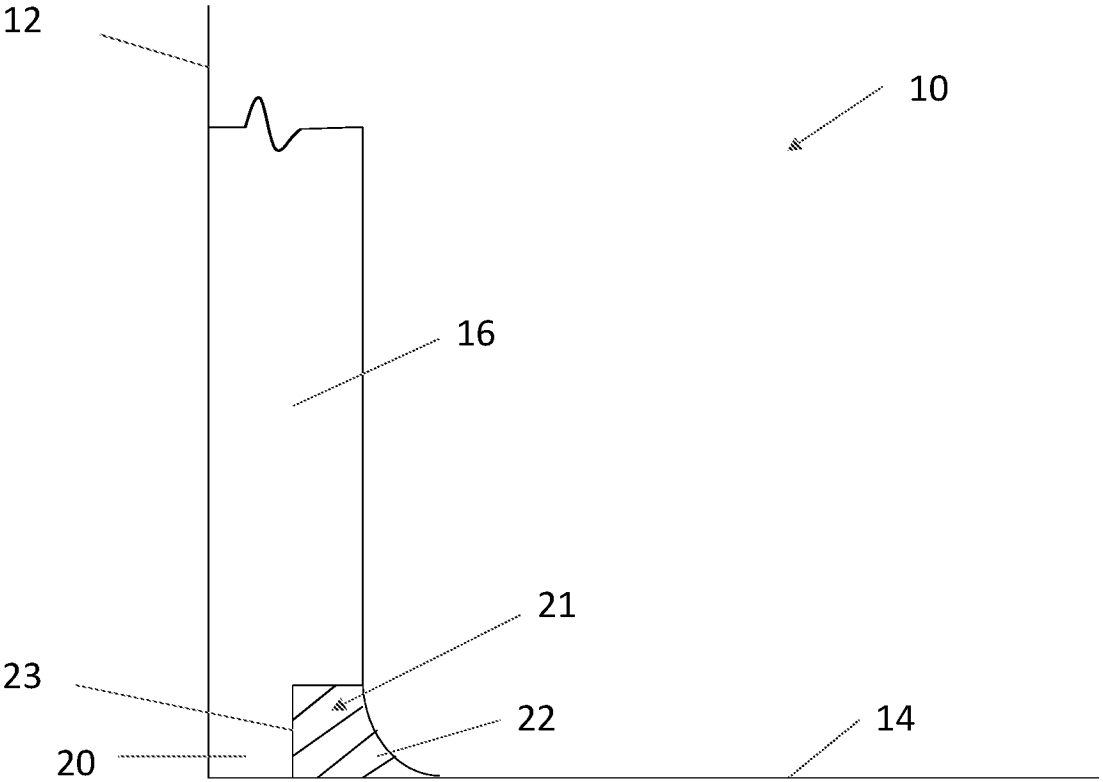
FIG. 5 is a side sectional view of another exemplary embodiment of the cove base.

FIG. 5 is a side sectional view of another exemplary embodiment of the cove base 10. The cove base 10 may be similar to the cove base 10 shown and described in FIG. 4 however the base 16 may extend vertically to the floor. The shoe 18 may not be required or may extend from the base 16 in a substantially straight line to the floor 14. The heel 20 may not be require or may extend from the base 16 or the shoe 18 in a substantially straight line to the floor 14.

Any of the cove bases 10 described herein may be comprised of any material, rigid or flexible. Any of the cove bases 10 described herein may comprise a shoe 18 or not. Furthermore, the use of a heel 20 is optional in all shown and described embodiments.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention.

Many of those variations and modifications will provide the same result and fall within the spirit of the claimed invention. It is the intention, therefore, to limit the invention only as indicated by the scope of the claims.

What is claimed is:

1. A cove base for providing a sealed connection between a wall and a floor using a sealant, the cove base comprising:

a base configured to receive an adhesive and extend along a portion of the wall at an elevated position from the floor when installed;

a shoe extending at an angle from a lower portion of the base and configured to extend towards, but not contact, the floor and away from the wall when installed;

a heel extending downward from the shoe to contact the floor when installed; and a channel located at a frontmost edge of the heel, wherein the channel is configured to receive the sealant;

wherein the channel comprises a rectangle shaped notched recess extending inward from the front edge of the channel.

2. The cove base of claim 1 wherein:

the channel comprises a curved edge extending from a lower edge of the heel to the front edge of the heel so as to form a concave recess.

3. A method for installing a cove base to a wall and a floor using a sealant, the method comprising the steps of:

providing a base along a portion of the wall, a shoe extending at an angle from the base towards the floor and away from the wall, and a heel extending from the shoe and contacting the floor, wherein the space between the heel, the shoe, and the floor defines a channel;

affixing the base to the wall;

providing the sealant within the channel;

and affixing the shoe to the floor;

wherein the heel extends towards the wall; and wherein the heel has a substantially circular cross-section.

4. The method of claim 3 wherein:

the step of affixing the base to the wall comprises the steps of:

providing an adhesive on a rear surface of the base, and placing the base in contact with the wall.

5. The method of claim 3 wherein:

the step of affixing the shoe to the floor comprises the steps of:

providing the sealant within the channel, and placing the shoe in contact with the floor.

* * * * *